US006814252B2

(12) United States Patent
Murakami et al.

(10) Patent No.: US 6,814,252 B2
(45) Date of Patent: Nov. 9, 2004

(54) INSULATING ENCLOSURE FOR A NECKED BEVERAGE BOTTLE

(75) Inventors: Yasuhiro Murakami, Roselle, IL (US); Anthony R. Seitz, Chicago, IL (US); Scott A. Borto, Aurora, IL (US)

(73) Assignee: Thermos L.L.C., Rolling Meadows, IL (US)

( * ) Notice: Subject to any disclaimer, the term of this patent is extended or adjusted under 35 U.S.C. 154(b) by 21 days.

(21) Appl. No.: 10/127,510

(22) Filed: Apr. 22, 2002

(65) Prior Publication Data

US 2003/0197020 A1 Oct. 23, 2003

(51) Int. Cl.[7] ..... B65D 25/20
(52) U.S. Cl. ..... 220/739; 220/903; 215/12.1
(58) Field of Search ..... 220/739, 740, 220/903, 737, 742; 215/12.1

(56) References Cited

U.S. PATENT DOCUMENTS 4,871,597 A * 10/1989 Hobson ..... 428/36.1
5,704,484 A * 1/1998 Spinks et al. ..... 206/521

* cited by examiner

*Primary Examiner*—Stephen Castellano
(74) *Attorney, Agent, or Firm*—Wood, Phillips, Katz, Clark & Mortimer

(57) ABSTRACT

Improved insulation for a necked beverage bottle is attained in a construction including a rigid, generally cylindrical container 10 having an open top and an insulated side wall 14, 16, 18 together with a generally cylindrical recess. A frustoconical top 12 is provided for the container 10 and is formed of a flexible, fabric-like insulating material 48. The top 12 further includes a base 34 sized to nest on the container 10 and an open, minor base 50 through which the neck of a beverage bottle may extend. Bayonet slots 40 and pins 32 releasably mount the top 12 on the cylindrical container 10.

3 Claims, 2 Drawing Sheets

INSULATING ENCLOSURE FOR A NECKED BEVERAGE BOTTLE

FIELD OF THE INVENTION

This invention relates to an insulator for beverage bottles, and more particularly, to an insulating enclosure for a beverage bottle of the type of the so-called "long necked" construction.

BACKGROUND OF THE INVENTION

Over the years, there have been a variety of proposals for insulators for beverage containers. A fairly common example is found in the type that is a cylindrical enclosure having an open top and which has a cylindrical side wall and a bottom wall of approximately ¼ inch in thickness and which is made out of a pliable foam. The same includes a generally cylindrical recess whose diameter is about or ever so slightly less than the diameter of a conventional beverage can (2⅝ inches) and a depth of about ¾ inch less than the height of a conventional beverage can, i.e., approximately 4 inches. A beverage can or bottle can be snugly received within the cylindrical recess and have its bottom wall and in the case of a can, most of its side wall enclosed by the insulator. Because the same is made of a pliable foam material, the cells in the foam provide dead air spaces that serve to provide the insulator with insulating qualities. The pliable nature of the foam allows the same to expand somewhat so that a beverage container may be snugly received in it, with the insulator itself frictionally gripping the sides of the beverage container.

Other types of insulators may include a rigid or semi-rigid cylindrical containing having a cylindrical recess and insulated side and bottom walls. In this case, the open top may be ringed with a plurality of relatively short, resilient, radially inward directing fingers which serve to engage the side wall of a conventional beverage container and frictionally hold the same in place.

Other examples of these type of insulators or beverage containers will undoubtedly occur to those skilled in the art. They all, however, suffer from one common disadvantage. Because they insulate only the cylindrical recess which receives the container, beverage containers of different shapes as, for example, bottles having necks on them, and particularly bottles of the so-called "long necked" configuration, have a substantial portion of their external surface protruding above the insulator and exposed to the ambient even when disposed in an insulator. As a consequence, such necked bottles are not efficiently insulated and the temperature of their contents approaches ambient temperature far more rapidly that would be the case if the same insulator were to be holding a conventional beverage can.

The present invention is directed to overcoming the foregoing problem.

SUMMARY OF THE INVENTION

It is the principal object of the invention to provide a new and improved insulating enclosure for a beverage container. More specifically, it is an object of the invention to provide an insulating enclosure for a necked beverage bottle. It is also an object of the invention to provide an insulating enclosure that may be used for not only insulating a necked beverage bottle, but a conventional beverage can as well.

An exemplary embodiment of the invention achieves one or more of the above objects in a construction that includes an insulating enclosure for a necked beverage bottle in which a rigid, generally cylindrical container having an open top and an insulated side wall is provided. The container includes a generally cylindrical recess of a diameter to relatively snugly receive the closed end of a beverage bottle. A frustoconical top is provided for the container and is formed of a flexible, fabric-like insulating material characterized by stretchability in two dimensions. The frustoconical top includes a rigid or semi-rigid ring-like major base sized to nest with the open top of the cylindrical container and an open, opposite minor base through which the neck of a beverage bottle may extend. Interengaging elements are provided on the cylindrical container and on the ring-like major base to releasably mount the frustoconical top on the open end of the cylindrical container to completely enclose a beverage bottle except for an end of the neck which protrudes through the open minor base.

In one embodiment of the invention, the cylindrical recess in the cylindrical container has a diameter in the range of about 2½ to 2¾ inches and a depth of about 3¾ to 4¼ inches so as to be capable of receiving a conventional beverage can to thereby serve as an insulating enclosure for a conventional beverage can when the frustoconical top is not used.

In a preferred embodiment, the major base is formed of plastic.

A preferred embodiment envisions that the insulating material is secured to the major base by stitching. An even more preferred embodiment includes a resilient, rubber-like ring stretched peripherally around the major base and covering the stitching.

According to a highly preferred embodiment of the invention, the major base includes a sleeve of semi-rigid plastic and has first, second and third outer diameter sections from top to bottom of the sleeve. The first section is of relatively small outer diameter and is peripherally covered by a lower edge of the insulating material. The third section is of relatively large outer diameter and is joined to the second section by a shoulder.

The second section is of intermediate outer diameter. Also provided is a resilient, rubber-like ring disposed about the sleeve and having an edge in substantial abutment with the shoulder and encircling the first and second sections.

In one embodiment of the invention, the interengaging elements include at least one bayonet slot on one of the cylindrical container and the frustoconical top and at least one pin receivable in the bayonet slot on the other of the cylindrical container and the frustoconical top. In a highly preferred embodiment, the bayonet slot is on the frustoconical top major base and the pin is on the cylindrical container.

A preferred embodiment of the invention contemplates that the frustoconical top insulating material includes at least two spaced U- or V-shaped cutouts extending downwardly from the minor base toward, but not to, the major base. A flexible stretch panel is provided for each of the cutouts and is secured to the side of and encloses the associated cutout.

Preferably, the stretch panel is stretchable in the circumferential direction and is fabric-like.

A preferred embodiment contemplates that each stretch panel be secured to the corresponding side by stitching.

The invention also contemplates that the minor base be defined by a ring of inverted U-shaped cross section and of fabric-like flexible stretch material stitched to the insulating material.

Other objects and advantages will become apparent from the following specification taken in connection with the accompanying drawings.

DETAILED DESCRIPTION OF THE PREFERRED EMBODIMENT

Figure 1:
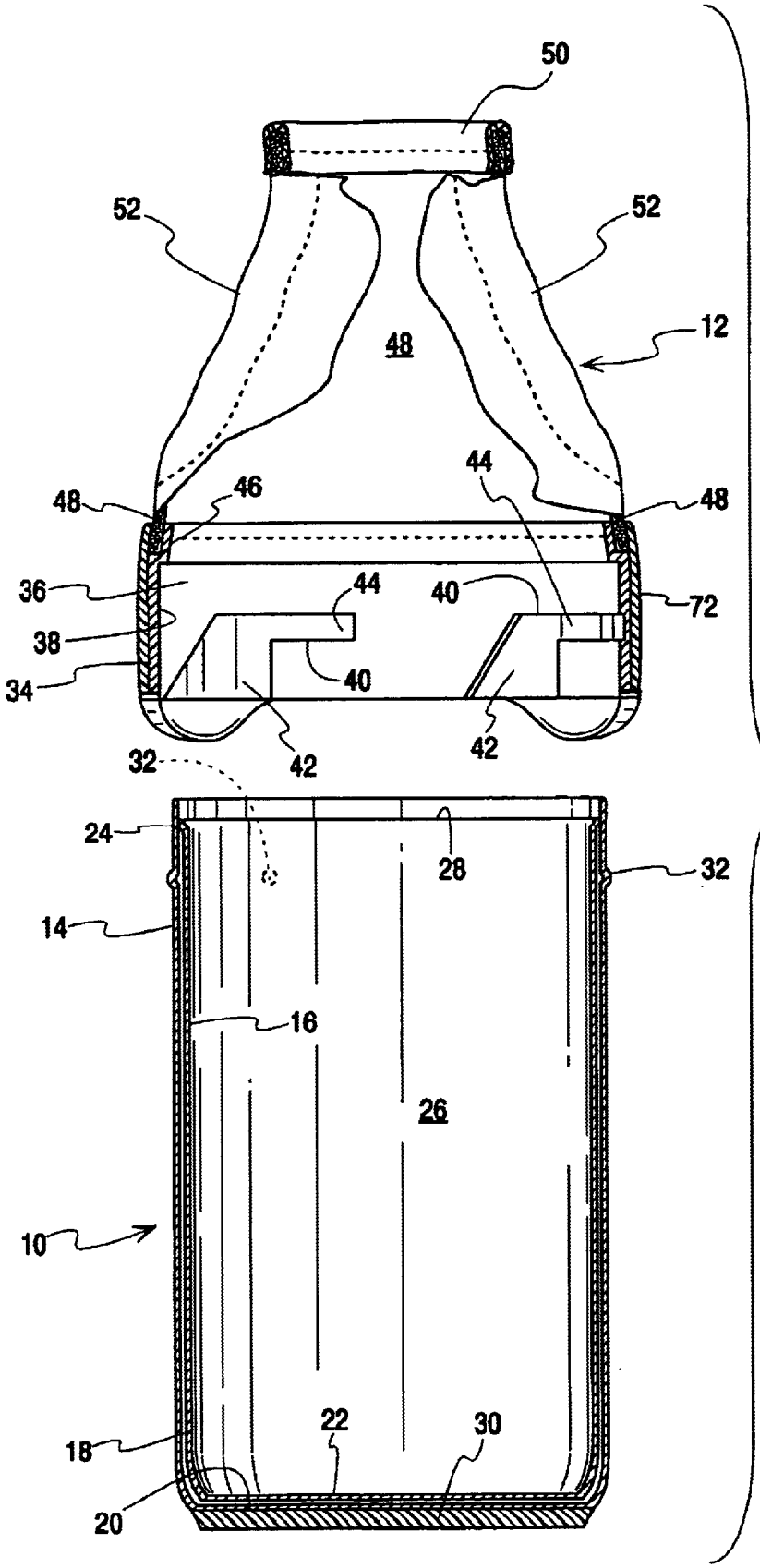
FIG. 1 is a vertical, exploded sectional view of an insulating enclosure for a necked beverage bottle made according to the invention.

An insulator for a necked beverage bottle, part of which may be also useful as an insulator for a conventional beverage can, is illustrated in FIG. 1 and is seen to include a generally cylindrical container, generally designated 10, and a removable, frustoconical top, generally designated 12. Referring to the container 10, the same includes a cylindrical outer liner 14, preferably provided with a decorative outer surface. Inwardly of the outer liner 14 is an inner liner 16. In the usual case, the liners 14 and 16 will be made of the same material which can include a metal, such as stainless steel or a plastic.

It is to be noted that the inner liner 16 is spaced from the outer liner by an insulating space 18 that extends about the side walls of the liners 14 and 16 and between the bottom walls 20 and 22 of the liners 14 and 16. The insulating space 18 is sealed and may be formed by pulling a vacuum on the space 18 in a conventional fashion or, in the alternative, may be filled with an insulating material such as foam or simply constitute a dead air space.

At its upper end, the inner liner 16 includes a radially outwardly directed neck 24 whose outer diameter is the same as the inner diameter of the outer line 14 and which is bonded metallurgically, as by welding or the like, to the outer liner 14 to seal the insulating space 18.

As a result of the foregoing construction, a cylindrical recess 26 is located primarily within the inner liner 18, although it extends upwardly to the upper edge of the outer liner 14 at a location 28 defined by the upper edge of the inner line 16. The cylindrical recess preferably has a diameter in the range of 2½ to 2¾ inches so as to relatively snugly receive both a conventional beverage can and a necked beverage bottle. To provide for use of the cylindrical container 10 as an insulator for conventional beverage cans only, the same preferably has a depth of about 3¾ to 4¼ inches.

At its bottom 20, the outer liner 14 includes a disk-like, anti-skid plate 30, preferably formed of a rubber-like material. Such a material will prevent the underside of the container 10 from possibly marring a supporting surface and stabilizes the entire container 10 and top 12 if placed on a surface of an object in motion, such as a vehicle.

Near its top, the outer liner 14 includes a plurality of stub-like pins 32 which extend radially outwardly. The pins 32 are preferably three in number and are located at equally angularly spaced intervals, i.e., 120°.

Figure 2:
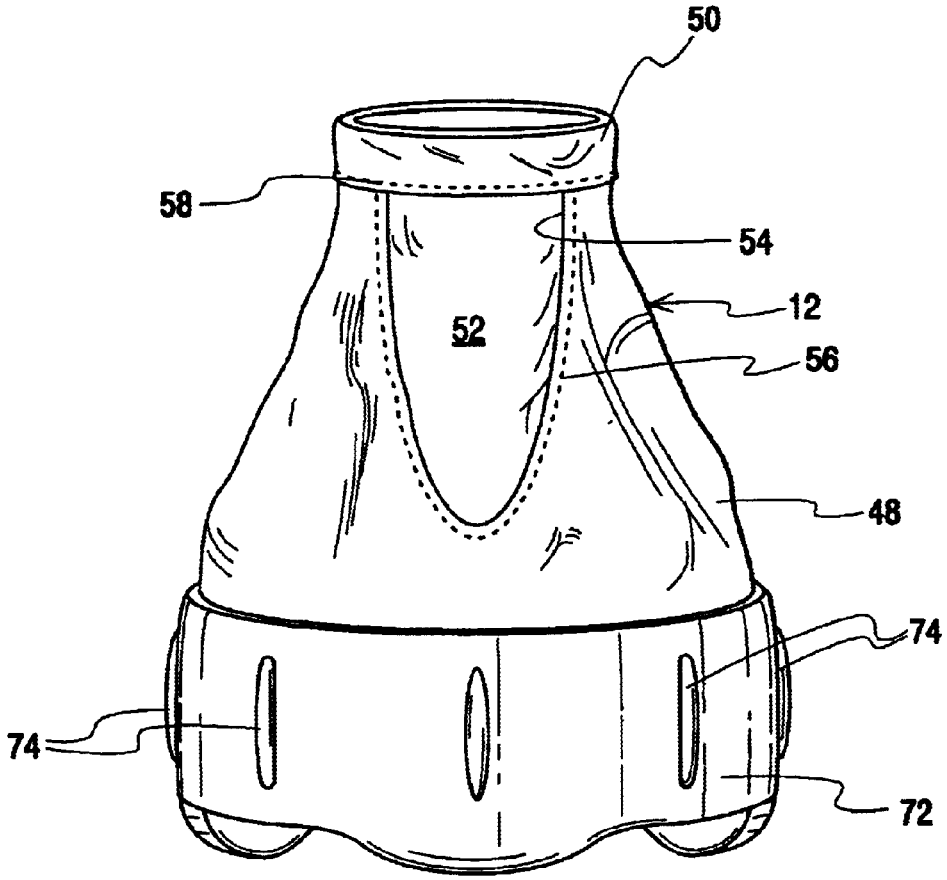
FIG. 2 is a perspective view from above of the top of the insulator.

Turning now to FIGS. 1 and 2, the frustoconical top 12 will be described in greater detail. The same includes a major base in the form of a sleeve 34 which may be formed of a rigid or semi-rigid plastic. Preferably, the sleeve 34 is formed of semi-rigid plastic. The inner wall 36 of the sleeve 34 has a stepped diameter with the lower segment 38 thereof being of just slightly greater diameter than the outer diameter of the outer liner 14. A plurality of bayonet slots 40 of conventional configuration, typically in the same as the number of the pins 32, are provided and have entrances 42 located at equally angularly spaced intervals, i.e., 120°. The entrances 42 open downwardly and preferably are flared so that they may be easily located about the pins 32.

The upper ends 44 of the bayonet slots 40 are generally horizontal so that when the major base 34 is twisted on the container 10 after the pins 32 have entered the bayonet slots 40, the major base will be retained thereon.

The sleeve 34, at its upper end, has a slightly reduced inner diameter as seen at 46.

The frustoconical top 12 includes a frusto cone 48 formed of a flexible, fabric-like insulating material which is preferably characterized by stretchability in two dimensions. That is, it may be stretched both circumferentially with respect to the major base 34 and longitudinally with respect to the major base 34 as well.

The frusto cone 48 is preferably woven of synthetic thread of poor thermal conductivity and is of sufficient thickness so that the weave contains substantial voids which serve as dead air spaces to provide the desired insulating capabilities.

Just above the major base 34 and extending to the minor base 50 of the top 12 are diametrically opposed stretch panels 52. As can be seen in FIG. 2, the insulating material forming the frusto cone 48 is provided with two, opposed, V- or U-shaped notches 54 in which the stretch panels 52 are received and secured in place as by stitching 56. The stretch panels 52 are also formed of a fabric-like, flexible material woven of thread that is a poor thermal conductor and which provides substantial void spaces within the panels 52 for insulating purposes. The stretch panels 52 are characterized, in the preferred embodiment, by stretchability in a single dimension, namely, the circumferential dimension.

The minor base 50 is formed of a ring of stretch fabric that has a generally U-shaped cross section at any point about its circumference. The upper ends of the material forming the frusto cone 48 and the stretch panels 52 are nested within the legs of the U-shaped ring defining the minor base 50 and the latter is secured to the former as by circumferential stitching 58.

Figure 3:
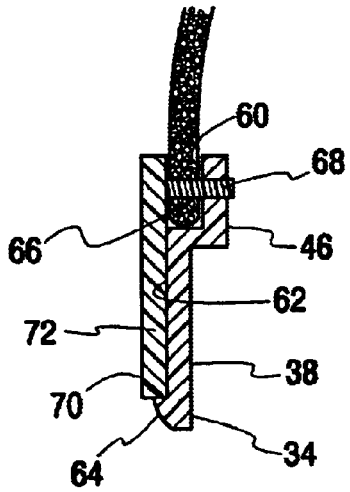
FIG. 3 is an enlarged, fragmentary sectional view of part of the major base of the top of the insulator.

Returning to the major base 34, reference is made to FIG. 3 wherein it is seen that the plastic sleeve defining the major base 34 includes integral first, second and third peripheral, outer sections 60, 62 and 64 respectively. From top to bottom, the first section 60 is of relatively small outer diameter and is peripherally covered by the lower edge 66 of the insulating material forming the frusto cone 48. Stitching 68 secures the lower edge 60 to the major base 34.

The third outer diameter section 64 is the lowermost and has a relatively large outer diameter. It joins to the second outer diameter section 62 which is of intermediate diameter, at a shoulder 70.

A resilient ring 72, preferably formed of a rubber-like material, is stretched about minor base 34 and has a height such that its lower edge lodges against the shoulder 70 as seen in FIG. 3 and its upper edge extends above the stitching 68 and covers the same, both for aesthetic purposes and to prevent wear, and possible premature failure, of the stitching 68. Further, because the ring 72 is formed of a rubber-like material, it is readily gripped by a user of the insulator allowing relative rotation between the container 10 and the top 12 to be easily obtained to open the container 10 as desired. If desired, vertical ribs or other projections 74 may be located about the outer periphery of the ring 72 to enhance its grippability.

In use, the top 12 is removed from the container 10. A beverage container is then located in the cylindrical recess 26. If the beverage container is a conventional can, nothing more need be done other than to open the beverage container to provide access to its contents. Because of the preferred dimensioning of the container 10 as set forth previously, the top of the conventional beverage can will extend somewhat above the upper edge of the outer liner 14 to permit access to the top by the lips of the user without interference with the insulating container 10 itself.

If the beverage container is a necked bottle, its cylindrical lower section is inserted into the cylindrical recess 26 and then the frustoconical top 12 fitted over the neck of the bottle such that the end of the neck just extends through the minor base 50. The top 12 is then nested on the container 10 with the pins 32 entering the bayonet slots 40. The top 12 may then be twisted relative to the container 10 to secure the top 12 in place. In this configuration, the insulating fabric forming the frusto cone 48 and the stretch panels 52 enclose all but the very top of the neck of the bottle to provide insulation for the neck area of the bottle in a fashion not achievable with conventional beverage container insulators.

Moreover, as recognized by those skilled in the art, necked beverage bottles come with necks of various tapers and lengths. Because of the stretchability of the insulating material 48 and the stretch panels 52, the top 12 may stretch to assume a configuration that will allow the beverage container and the top 12 to be used with even the "fattest" of the available long neck configurations. Further, because the material 48 may stretch longitudinally, the top 12 may accommodate necked beverage bottles having extremely long necks as well as those having shorter necks. The diameter of the opening of the neck may vary substantially and still be accommodated by the top 12 because of the stretchability of the minor base 50. That same stretchability also accommodates extremely long necks on bottles because the minor base 50 as well as the material 48 may stretch circumferentially to embrace the lower, and generally fatter, sections of extremely long necks of necked bottles.

It should be kept in mind that while an exemplary embodiment of the invention has been described, numerous modifications will readily occur to those skilled in the art. For example, the interengaging elements in the form of the bayonet slots 40 and the pins 32 could readily be replaced by mating threads or other readily releasable fasteners even including, for example, snap action fasteners. The securing of various components of the frustoconical top 12 together could be accomplished by means other than the stitching disclosed if desired. For example, welding techniques could be employed as, for example, sonic welding, thermal welding or solvent welding. And, if desired, pliable, stretchable foams could be used to form the frusto cone 48 and the panels 52. Numerous other examples of modifications will be apparent.

What is claimed is:

1. An insulating enclosure for a necked beverage bottle comprising:

a rigid, generally cylindrical container having an open top and an insulated side wall, said container having a generally cylindrical recess of a diameter to relatively snugly receive the closed end of a beverage bottle;

a frustoconical top for said container and formed of a flexible resilient insulating material characterized by stretchability in two dimensions, said frustoconical top including a rigid or semi-rigid ring-like major base sized to nest with said open top and an open, opposite minor base through which the neck of a beverage bottle may extend, said insulating material being secured to said major base by stitching;

a resilient rubber-like ring stretched peripherally around said major base and covering said stitching; and interengaging elements on said cylindrical container and on said ring-like major base releasably mounting said frustoconical top on said cylindrical container open end to completely enclose a beverage bottle except for an end of the neck thereof.

2. An insulating enclosure for a necked beverage bottle comprising:

a rigid, generally cylindrical container having an open top and an insulated side wall, said container having a generally cylindrical recess of a diameter to relatively snugly receive the closed end of a beverage bottle;

a frustoconical top for said container and formed of a flexible resilient insulating material characterized by stretchability in two dimensions, said frustoconical top including a rigid or semi-rigid ring-like major base sized to nest with said open top and an open, opposite minor base through which the neck of a beverage bottle may extend;

said major base comprising a sleeve of semi-rigid plastic and having first, second and third outer diameter sections from top to bottom of the sleeve, said first section being of relatively small outer diameter and being peripherally covered by a lower edge of said insulating material, said third section being of relatively large outer diameter and joined to said second section by a shoulder, said second section being of an intermediate outer diameter, and a resilient rubber-like ring disposed about said sleeve and having an edge in substantial abutment with said shoulder and encircling said first and second sections; and interengaging elements on said cylindrical container and on said ring-like major base releasably mounting said frustoconical top on said cylindrical container open end to completely enclose a beverage bottle except for an end of the neck thereof.

3. An insulating enclosure for a necked beverage bottle, comprising:

a rigid, generally cylindrical container having an open top and an insulated side wall, said container having a generally cylindrical recess with a diameter in the range of about 2½ to 2½ inches and a depth of about 3¾ to 4¼ inches so as to alternatively, relatively snugly receive the closed end of a beverage bottle or a conventional beverage can;

a frustoconical top for said container and formed of a flexible fabric-like insulating material characterized by stretchability in two dimensions, said frustoconical top including a major base formed of a rigid or semi-rigid plastic and sized to nest with the open top of said container and having an open, opposite minor base through which the neck of a beverage bottle may extend, said major base comprising a sleeve having first, second and third outer diameter sections from top to bottom of the sleeve, said first section being of relatively small outer diameter and being peripherally covered by a lower edge of said insulating material, said third section being of relatively large outer diameter and joined to said second section by a shoulder, said second section being of an intermediate outer diameter, and a resilient rubber-like ring disposed about said sleeve and having an edge in substantial abutment with said shoulder and encircling said first and second sections, and stitching securing said lower edge to said first section and being covered by said rubber-like ring, said insulating material including two diametrically opposite U- or V-shaped cutouts extending downwardly from said minor base toward, but not to, said major base, and a flexible stretch panel for each of said cutouts, secured to the sides of the associated cutout by stitching and closing the associated cutout, said minor base being defined by a ring of inverted U-shaped cross section and of a fabric-like flexible stretch material and stitched to said insulating material; and interengaging elements on said cylindrical container and on said major base releasably mounting said frustoconical top on said cylindrical container open end to completely enclose a beverage bottle, except for an end of the neck thereof, said interengaging elements comprising bayonet slots on said major base and pins on said cylindrical container.

* * * * *